US005707319A

United States Patent [19]

Riley

[11] Patent Number: 5,707,319

[45] Date of Patent: Jan. 13, 1998

[54] TREADMILL ADAPTIVE SPEED CONTROL

[76] Inventor: Ronald J. Riley, 1323 W. Cook Rd., Grand Blanc, Mich. 48439

[21] Appl. No.: 700,801

[22] Filed: Aug. 21, 1996

[51] Int. Cl.[6] ..... A63B 22/02

[52] U.S. Cl. ..... 482/54; 422/901

[58] Field of Search ..... 482/54, 70, 71, 482/72, 62, 51, 901, 902

[56] References Cited

U.S. PATENT DOCUMENTS

| | | | |
|---|---|---|---|
| 3,711,812 | 1/1973 | Cherry . | |
| 4,364,556 | 12/1982 | Otte | 482/902 |
| 4,426,075 | 1/1984 | Otte . | |
| 4,765,315 | 8/1988 | Krukowski | 482/901 |
| 4,771,148 | 9/1988 | Bersonnet . | |
| 5,100,127 | 3/1992 | Melnick et al. . | |
| 5,314,391 | 5/1994 | Potash et al. . | |
| 5,368,532 | 11/1994 | Farnet . | |
| 5,474,510 | 12/1995 | Chen . | |
| 5,476,430 | 12/1995 | Lee et al. . | |

*Primary Examiner*—Lynne A. Reichard
*Attorney, Agent, or Firm*—John R. Benefiel

[57] ABSTRACT

A treadmill having an adaptive speed control for the belt drive in which members engageable by the user to be pulled have signal generators associated therewith to enable signals proportioned to the degree of pulling to be used to correspondingly reduce a selected belt speed so that a lagging pace of the user is detected and the belt speed reduced automatically. Hand rails and/or pivoted vertical poles can be used as the user-engageable members. The mean position of the poles can be monitored to generate signals corresponding to the degree of pulling exerted by the user.

12 Claims, 3 Drawing Sheets

TREADMILL ADAPTIVE SPEED CONTROL

BACKGROUND OF THE INVENTION

This invention concerns treadmills and more particularly treadmill controls for providing improved safety for users.

Treadmills employ an endless powered belt loop supported so that an upper run of the belt loop requires the user to run or walk at a predetermined pace based on the speed of the belt loop which is driven by a drive motor. The speed that the belt is driven is controlled selectively and may vary over a particular program segment in order to allow the user to execute a particular exercise regimen.

The powering of the belt loop creates potential hazards in that the user is required to keep up with the pace set by the speed of the belt and if the user loses balance or is suddenly stricken in some way, the belt motion will cause the user to be driven off the end of the treadmill, perhaps causing personal injury.

Treadmill controls have heretofore been devised to reduce the possibility of such occurrence, including the now standard feature of a tether control which consists of a cord connected at one end to the user in some fashion and at the other end to a switching arrangement such that if the user moves beyond the slack allowed by a connected length of cord, a switch is operated to cause the belt drive motor to be automatically shut down.

While effective when used properly, the user must take the precaution of putting the loop on his or her wrist prior to beginning a session. Human nature being as it is, many users will neglect this step and thus are not protected against the danger described above.

More sophisticated controls have been proposed in order to provide adaptive speed control to better address this deficiency. In addition to the tether arrangements, there has also been developed emergency shutoffs associated with the handgrips as described in U.S. Pat. No. 4,426,075 issued on Jan. 17, 1984 for "An Emergency Shutoff Switch for Exercise Apparatus;" U.S. Pat. No. 4,364,556 issued on Dec. 21, 1982 for "An Emergency Shutoff Switch and Frame Assemblies for Exercise Apparatus;" and, U.S. Pat. No. 4,771,148 issued on Sep. 13, 1988 for an "Exercise Machine Switch." These arrangements provide a shutoff switch associated with the hand rails so as to not require the user to place the tether strap around his wrist, but rather rely on the instinctive grasping of the hand rails when the user is losing his or her balance or is otherwise unable to keep up with the treadmill belt.

An adaptive speed control is another desirable feature, in which the speed of the treadmill is automatically adjusted to match the pace that the user is able to maintain.

U.S. Pat. No. 5,368,532 issued on Nov. 29, 1994 for a "Treadmill Having an Automatic Speed Control System" and U.S. Pat. No. 5,314,391 issued on May 24, 1994 for an "Adaptive Treadmill" both describe adaptive speed control systems.

In U.S. Pat. No. 5,368,532, sensors are utilized for detecting the position of the user on the treadmill belt which provides both a change in speed and also an emergency stop depending on the sensed position of the user.

U.S. Pat. No. 5,314,391 utilizes a sonar detection system to accomplish the same result.

Such arrangements require sophisticated sensors and controls which increase the cost of the treadmill substantially and also may effect the reliability of the operation of the treadmill due to their complexity.

None of the above-described arrangements addresses the situation where the treadmill is equipped with vertical poles which are gripped and oscillated by motion of the user's arms and upper body to provide a total body workout. In such treadmills, the users will be less likely to grab for the hand rails when he or she is already gripping the vertical poles.

Furthermore, the switching arrangement used with relatively stationary hand rails will not be effective with the vertical poles in that these poles are designed for oscillating travel as the user engages in the upper body workout when striding on the treadmill belt.

Accordingly, it is the object of the present invention to provide an improved treadmill control for effecting an emergency shut off without the use of a tether and for providing adaptive speed control in a simplified reliable manner.

It is another object of the present invention to provide improved adaptive speed control and emergency shutoff for treadmills equipped with upper body exercising poles.

SUMMARY OF THE INVENTION

The above-recited objects and others which will become apparent upon a reading of the following specification and claims are achieved by the present invention which modifies the selected belt speed in correspondence to the degree of pulling action exerted by the user on a user-held member, the member mounted on the treadmill so as to be able to be pulled by the user during striding on the belt. In one embodiment, a mounting of the horizontal hand rails allows limited relative movement thereof against a stiff spring resistance. A potentiometer or other low cost, reliable proportional electrical signal generator is coupled to the hand rail to produce an output signal in correspondence to the degree of rearward travel of the hand rail. This signal is directed to a speed control circuit for the treadmill drive motor in such a manner as to modify the selected control speed to reduce the treadmill speed in correspondence to the extent of rearward travel of the hand rails.

Once the hand rail travel reaches a predetermined extent, an emergency shutoff is initiated.

The spring biasing of the hand rails may be augmented with a mechanical dampening such as with a hydraulic shock absorber to create dampening of the control system to smooth out changes in speed otherwise caused by momentary movements of the hand rails.

Alternatively, an electronic dampening of the control circuit can be employed.

In a second embodiment of the invention particularly adapted to oscillating poles used for an upper body workout, the angular position of each pole as it is oscillated is monitored by means of rotary encoders to generate corresponding electrical signals. A signal corresponding to the mean position of the poles during oscillation is generated electronically by an integrator logic, which then provides an electrical output signal corresponding to the mean position of the poles during the user's oscillation thereof.

This mean position signal is utilized in a control circuit for the treadmill belt drive motor such that as the location of the mean position of the ski poles moves rearwardly, indicating the user is not keeping up with the pace set by the selected speed control, the speed of the drive motor is adjusted downwardly to slow the belt to match the pace being set by the user upon the location of the mean position reaching a certain extreme rearward point and an emergency shutdown can then be initiated.

The hand rails can also each be mounted to a load cell which generates signals corresponding to the pulling force exerted by the user. The selected belt speed is modified in correspondence to the degree of the pulling force exerted by the user, which in turn is correlated to the extent to which the user is lagging the belt pace. Again, the drive motor is shut down if the pulling force exceeds a predetermined level.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
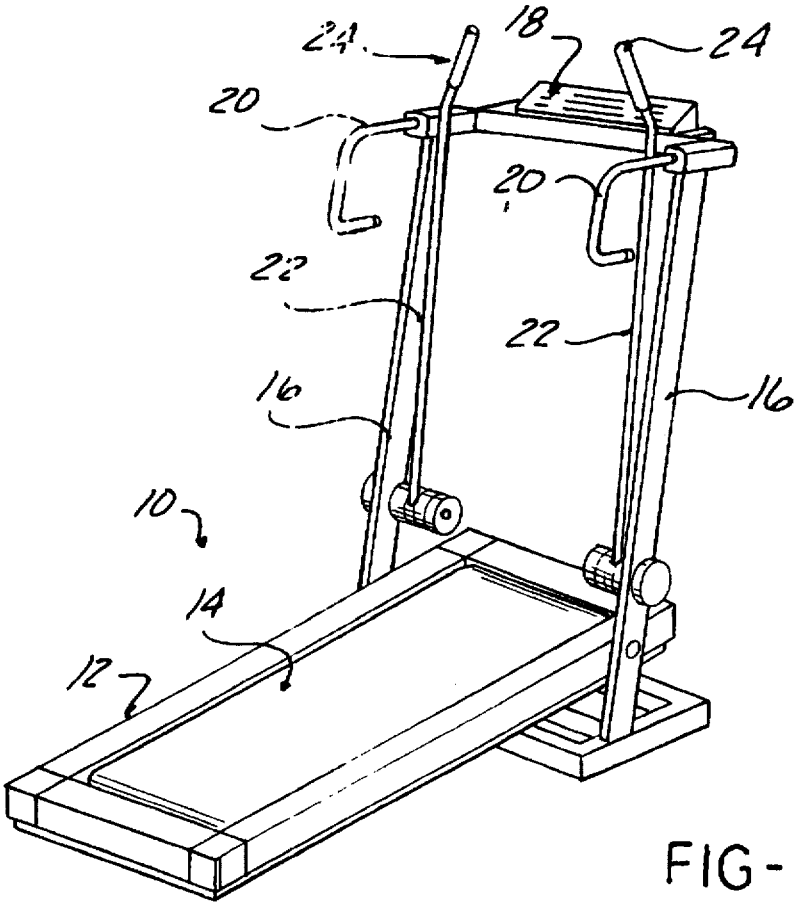
FIG. 1 is a perspective view of a treadmill exercise device equipped with the treadmill control arrangement according to the present invention.

Referring to the drawings and particularly FIG. 1, a treadmill 10 is shown, comprised of a generally rectangular platform 12 on which is mounted an endless belt loop 14 which is adapted to be recirculated by a drive motor in conventional fashion.

A pair of upright frame members 16 on a respective side of the platform 12 supports a control panel 18 which allows selection of a particular speed and belt platform inclination program. A pair of user-held hand rails 20 are each mounted to an upper end of a respective upright frame member 16. The hand rails 20 are capable of limited sliding movement against a stiff spring resistance, as will be described hereinafter.

Also provided is a pair of generally upright poles 22 each pivotally mounted to one side of the lower region of an upright frame member 16 such as to be able to be oscillated by arm and shoulder motion of a user gripping the hand grips 24 at the upper end of each pole 22. Such general arrangement is conventional.

Figure 2:
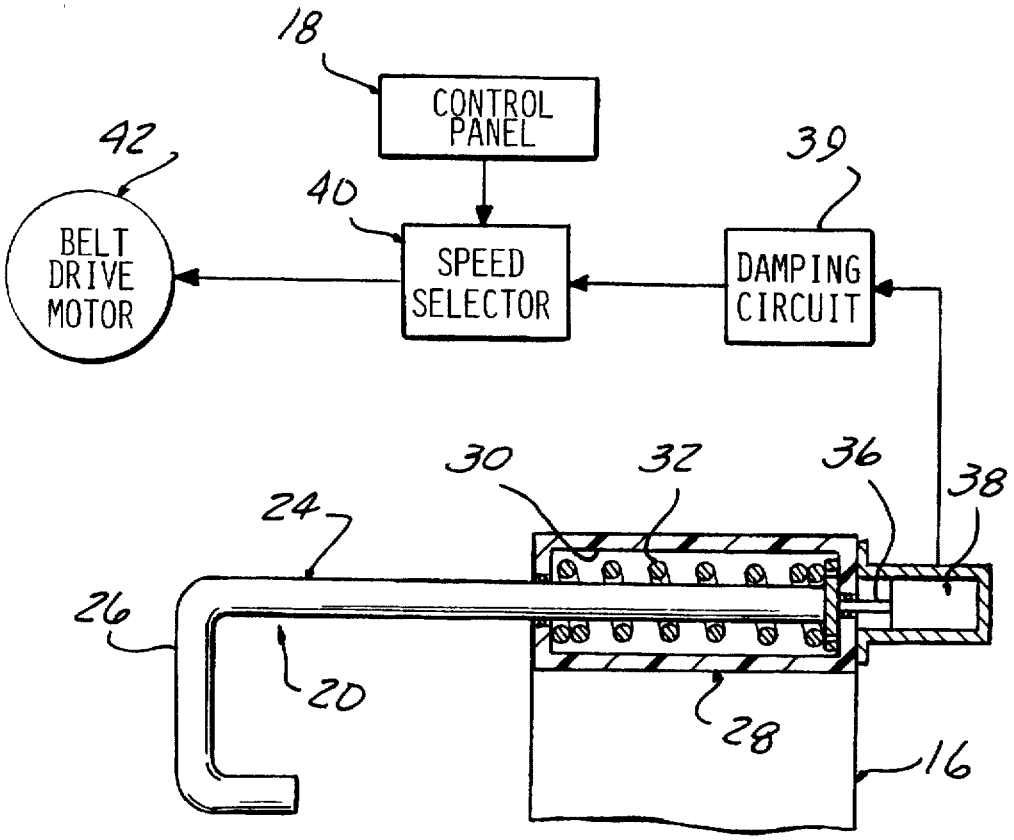
FIG. 2 is a diagrammatic representation of the hand rail and associated control circuit components.

Referring to FIG. 2, the particular mounting arrangement for the hand rails 20 and the associated control components are illustrated diagrammatically. The hand rail 20 includes a generally horizontally extending main section 24 and a rounded or hooked rear section 26 which is located at a height able to be easily grasped by the user either continuously during the workout or when attempting to maintain his or her balance.

It will be understood that a side rail structure could also be used in place of the hand rail.

The forward end of each of the hand rails 20 are received into a housing 28 mounted fixedly to the upper end of the respective upright frame member 16. The horizontal portion 24 of each hand rail 20 is slidable in a bore 30 in the housing 28 against the bias of a relatively stiff compression spring 32 received over the outside of the hand rail portion 24. A flange 34 on the very end of the hand rail section 24 causes the compression spring 32 to exert a force on the hand rail 20 resisting movement to the rear of the housing 28.

An extension rod 36 is attached to the flange 34 and is connected to a linear potentiometer indicated generally at 38. The potentiometer 38 provides an electrical output signal in correspondence with the extent of linear movement of the hand rail 20 out of the housing 28 from a rest position.

This electrical signal corresponds to the degree of pulling force exerted by the user, which in turn indicates the extent, if any, to which the user is lagging pace with the speed of the conveyor belt 14 selected by the use of the control panel 18.

A damping circuit 39 to electronically damp the signal generated by the potentiometer 38 can be provided to eliminate the effects of momentary jerks on the hand rail 24.

This electrical signal is applied to a speed selector circuit 40 to modify the selected speed and automatically reduce the speed of the treadmill drive motor 42 if the user's pace is lagging the belt at selected speed.

In the event a predetermined extension of the hand rails 20 is reached, corresponding to a maximum allowable extent of lagging of the user, the treadmill motor 42 will be shut off.

Figure 3:
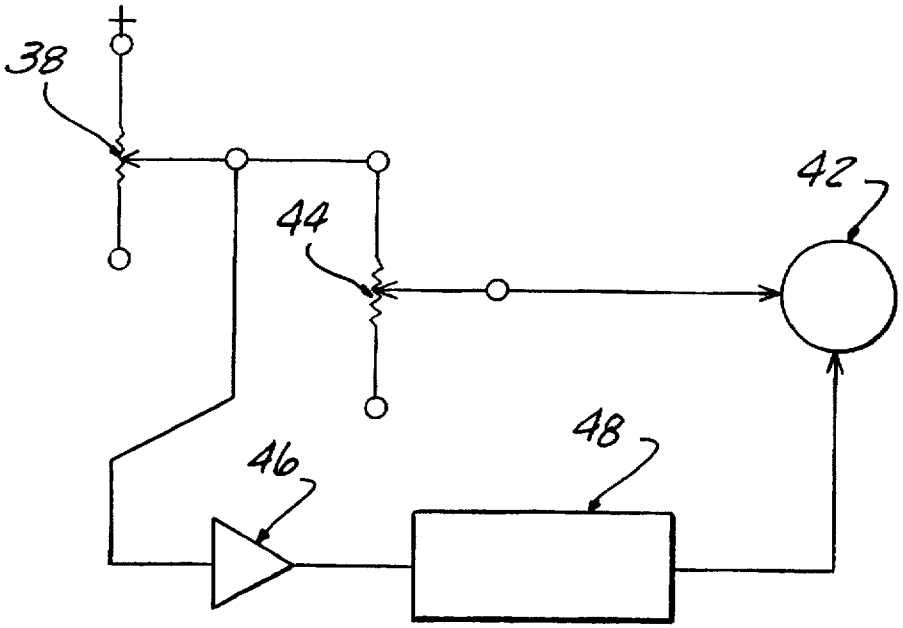
FIG. 3 is a block diagrammatic representation of an example of the electrical control associated with the hand rail arrangement shown in FIG. 2.
Figure 4:
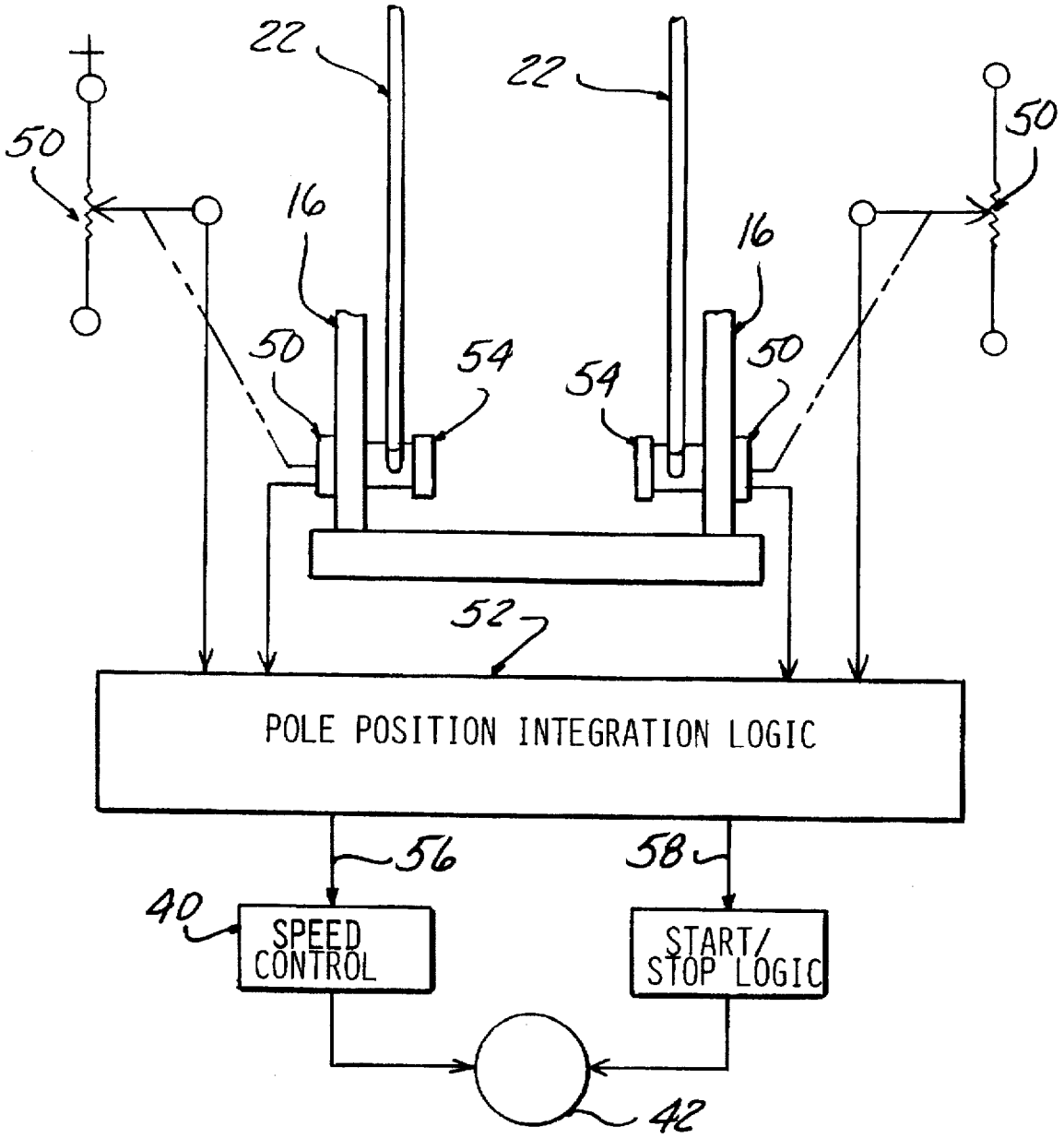
FIG. 4 is a block diagrammatic representation of the upper body workout poles and the associated control circuit components.

FIG. 3 illustrates an exemplary circuit diagram for carrying out the control scheme illustrated in FIG. 2. A pair of potentiometers 38, 44 are provided, the first a selector potentiometer 44 being used to create a manipulation signal by a manual selection of the switch on the control panel 18. The second potentiometer 38 is provided to generate a feedback signal for modifying the signal generated by the selector potentiometer 44. The second potentiometer is mechanically connected to the hand rail as illustrated in FIG. 2.

An output signal from the feedback potentiometer 38 can be separately utilized in a maximum travel detector logic element 46 to stop or cease the operation of the treadmill drive motor 42. An optional timer 48 may be employed to prevent shutdown for excursions of very brief duration.

As an alternate approach, the bore 30 may contain hydraulic fluid such that movement of the flange 34 is retarded to create a mechanical dampening of the system, delaying retraction of the hand rail 24 whenever a pulling force is exerted thereon.

This prevents shutdown of the motor 42 as a result of momentary pulls on the hand rails 20.

FIG. 3 illustrates an embodiment in which the vertical poles 22 comprise the user-engageable members of the adaptive speed control.

A rotary encoder 50 continuously generates an electrical signal corresponding to the angular position of each of the poles 22 about their pivotal mounts. The continuously generated signal is transmitted to a position integrator 52 which generates electrical signals corresponding to the mean position of the poles 22 in their oscillatory movement. This mean position signal is transmitted to the speed selector 40 such as to reduce the speed of the treadmill motor 42 to the extent the location of the mean position of the poles 52 shifts rearwardly from a neutral location, indicating the extent to which the user has lost pace with the speed of the treadmill belt 14.

If the mean pole position shifts to the rear of a neutral position to a predetermined maximum allowable extent, a stop signal is caused to be presented on terminal 58 which is transmitted to start-stop logic to shut off the drive motor 42.

The rotary encoder 50 may take the form of a potentiometer for each pole 22 with the electrical output signal transmitted to the position integrator logic 52 and a continuously variable speed control signal is generated at output terminal 56.

As before, a mechanical dampening device 54 may be provided connected to the pivotal mounting of the handle 22 such as to be rotated thereby and generate a viscous dampening force and create resistance to oscillation of the poles 22.

Figure 5:
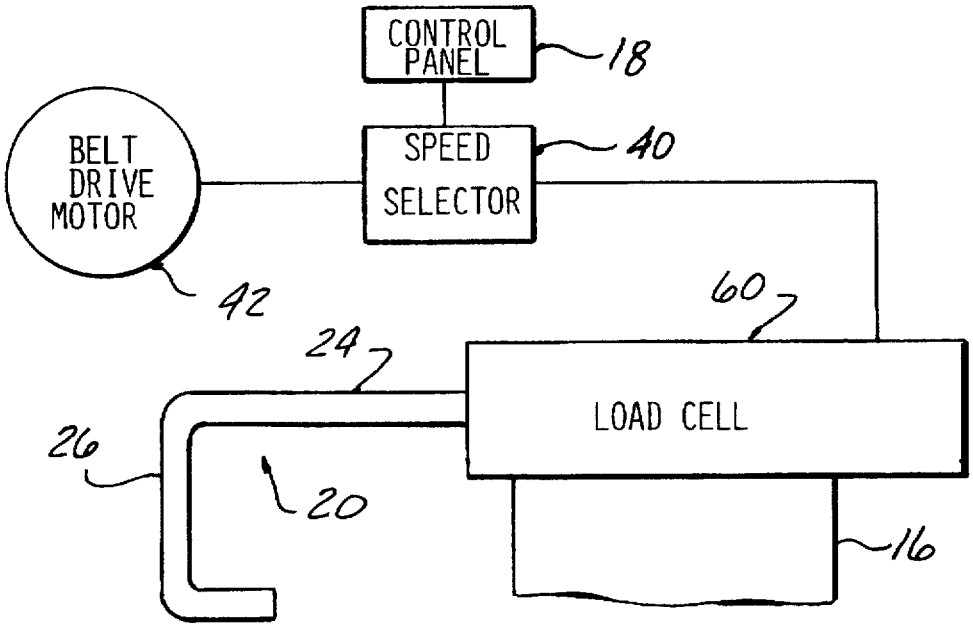
FIG. 5 is a block diagrammatic representation of a modified form of the embodiment of FIGS. 1 and 2.

FIG. 5 shows a modified form of the embodiment of FIGS. 1 and 2, in which the hand rail 20 has its section 24 immovably mounted by being attached to a load cell 60, which generates electrical output signals corresponding to the magnitude of a rearward pulling force exerted by the user. This signal is used to modify the selected belt speed by correspondingly reducing the speed control signal in proportion to the magnitude of the pulling force signal.

Many other alternate arrangements of the above-described embodiments are possible. For example, the conventional wrist tether can be used as the user-engageable member for establishing adaptive speed control. Instead of a stiff spring, bending deflection of a hand graspable member can be used to generate a spring resistance.

I claim:

1. A treadmill having a platform, an endless belt loop supported on said platform so as to have an upper belt run on which a user may stride and a drive motor for recirculating said endless belt, selectively operated controls for operating said drive motor at a selected speed to drive said endless belt at a selected speed, an improved drive motor control comprising:

a user-held member configured to be pulled by a user while striding on said upper run of said endless belt loop;

adaptive speed control means including control signal generating means responsive to the degree of pulling action exerted on said member to generate control signals proportional to the degree of pulling exerted by said user, and to reduce selected belt speed to an extent corresponding to the magnitude of said control signals.

2. The treadmill according to claim 1 including a pair of said members, each comprising a hand rail mounted on a respective side of said platform at a level above said platform to be readily graspable by a user striding on said belt upper run.

3. The treadmill according to claim 1 further including a pair of said members, each comprising an upright pivotable pole mounted on a respective side of said platform, each pole having a hand grip graspable by a user while striding on said belt upper run, said user thereby able to swing said poles on said pivotal mounts while striding on said belt upper run.

4. The treadmill according to claim 2 wherein said hand rails are each mounted for limited rearward travel and means are included for generating a resistive force acting against said rearward travel and wherein said control signal generating means is responsive to the extent of rearward travel of each of said hand rails against said spring force to generate said proportioned control signals.

5. The treadmill according to claim 2 wherein each of said hand rails is fixed to a respective load cell responsive to the level of rearward pulling force exerted thereon by a user to generate said proportioned control signals.

6. The treadmill according to claim 5 wherein said signal generating means includes a potentiometer.

7. The treadmill according to claim 3 wherein said signal generating means includes a position sensor for each pole generating electrical signals corresponding to the angular position of said pole, and means receiving said position signals and generating signals corresponding to the mean position of said poles for each oscillation produced by the user swinging said poles and means causing said selected belt speed to be reduced to an extent corresponding to the rearward shift of said mean position.

8. The treadmill according to claim 4 further including means for damping said travel of said hand rail members.

9. The treadmill according to claim 7 further including means mechanically damping said oscillation of said poles.

10. The treadmill according to claim 7 wherein each position sensor comprises an encoder driven by rotation of said poles.

11. The treadmill according to claim 4 further including means for damping rearward movement of said hand rails.

12. The treadmill according to claim 1 further including circuit means damping said position signals generated by said control signal generating means.

* * * * *